US006402977B1

(12) United States Patent
Tamura et al.

(10) Patent No.: US 6,402,977 B1
(45) Date of Patent: Jun. 11, 2002

(54) COMPOSITION FOR RESIN MAGNET, MAGNETIC MEMBER USING SAME AND PROCESS FOR PRODUCING SAID MAGNETIC MEMBERS

(75) Inventors: Hajime Tamura, Kanagawa-ken; Yasuro Shiomura; Munenori Iizuka, both of Tokyo, all of (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/382,632

(22) Filed: Aug. 25, 1999

(30) Foreign Application Priority Data

Sep. 30, 1998 (JP) ..... 10-278386

(51) Int. Cl.[7] ..... H01F 1/37
(52) U.S. Cl. ..... 252/62.52; 264/429; 492/8
(58) Field of Search ..... 252/62.54; 264/429; 492/8

(56) References Cited

U.S. PATENT DOCUMENTS 6,190,573 B1 * 2/2001 Ito ..... 252/62.54

FOREIGN PATENT DOCUMENTS

JP 62234304 A * 10/1987

* cited by examiner

*Primary Examiner*—C. Melissa Koslow
(74) *Attorney, Agent, or Firm*—Oblon, Spivak, McClelland, Maier & Neustadt, P.C.

(57) ABSTRACT

There are disclosed a composition for resin magnets which comprises a thermoplastic resin and magnetic powders and which, when determined in a heated molten state, has specific viscosity characteristics characterized in that the almost linear line which is obtained by taking $\eta_R/\eta_O$ as ordinate and $\gamma$ as abscissa has a slope of at most 0.02, preferably at most 0.01 within a specific temperature range in which $\eta_O$ falls within the range of from $2.0\times10^6$ to $1.0\times10^7$ dyne/cm$^2$, wherein $\eta_R$ denotes shear stress (dyne/cm$^2$), $\eta_O$ denotes yield stress (dyne/cm$^2$) and $\gamma$ denotes shear rate ($S^{-1}$); a magnetic member which is produced by the use of the above composition for resin magnets; and a process for efficiently producing the magnetic member from the composition by an extrusion molding in a magnetic field under specific temperature and pressure conditions. The above composition for resin magnets has specific viscosity characteristics, and thereby enables to readily afford a magnetic member having a strong magnetic force such as magnet rollers and magnet pieces. Accordingly, the magnetic member is well suited for use in the field of electrophographic equipment and electrostatic recording equipment such as copying machinery, facsimile machinery and printers.

14 Claims, 10 Drawing Sheets

COMPOSITION FOR RESIN MAGNET, MAGNETIC MEMBER USING SAME AND PROCESS FOR PRODUCING SAID MAGNETIC MEMBERS

BACKGROUND OF THE INVENTION

1. Field of the Invention

The present invention relates to a composition for resin magnets, a magnetic member using the same, and a process for producing said magnetic member. More particularly, the present invention pertains to a composition for resin magnets which is well suited for producing a magnetic member having a strong magnetic force, a magnetic member such as magnet rollers and magnet pieces which is produced by the use of the aforesaid composition, and a process for efficiently producing the aforesaid magnetic member.

2. Description of the Related Arts

There is known, in the field of electrophographic equipment and electrostatic recording equipment such as copying machinery and printers, a method for visualizing an electrostatic latent image by locating a magnet roller which is formed with a composition for a resin magnet in a rotating sleeve as a developing roller for the purpose of visualizing an electrostatic latent image on a latent image holding body such as a photosensitive drum and by supplying the surface of the latent image holding body with a magnetic developer (toner) through a so-called jumping phenomenon that allows the toner which is held on the surface of the sleeve to jump over onto the latent image holding body by means of the magnetic characteristics of said magnet roller.

The above-mentioned magnet roller has heretofore been produced by injection molding or extrusion molding of a composition for resin magnets in which magnetic powders are mixed with a thermoplastic resin binder, by the use of a mold which generates a magnetic field on the circumference of a cavity thereof to mold the composition into the form of roller and magnetize to desired magnetic force characteristics.

There is a tendency that a magnet roller is called upon to be equipped with further intricate magnetic force patterns with the recent advance of electrophographic equipment and the like. However, there has been a limitation on the magnetic force patterns designable with conventional magnet rollers, thereby making it impossible to sufficiently respond to the above-mentioned requirement.

In such circumstances in order to enhance the degree of freedom for the magnetic force pattern of a magnet roller, there has recently been constituted a desired magnetic force pattern by molding the above-mentioned composition for resin magnets into a plurality of magnet pieces that are magnetized to have magnetic poles according to the desired magnetic force pattern and sticking the resultant magnet pieces onto the surroundings of the shaft of the magnet roller.

As such composition for resin magnets for the purpose of producing a magnetic member such as magnet rollers and magnet pieces, there has heretofore been employed a composition of a resin binder comprising, as a principal component, a polyamide resin such as polyamide-6 and polyamide-12, or a thermoplastic resin such as propylene resin, vinyl chloride resin and ethylene/ethyl acrylate copolymer resin (EEA), and magnetic powders of ferrite, a rare earth metal magnet or the like that are mixed with and dispersed in said resin binder.

In addition, there are principally adopted an injection molding method in a magnetic field and an extrusion molding method in a magnetic field as a method for molding the composition into a magnetic member. In these cases, the injection molding method enables to produce a magnetic member having enhanced magnetic characteristics, since said method injects molten composition for resin magnets in a state of applying a magnetic field to a mold so as to orientate the magnetic powders in said composition for resin magnets in accordance with the resultant magnetic field, whereby said composition for resin magnets is allowed to cool in the mold to reach such a level of a viscosity that the foregoing orientation state is preserved.

On the contrary, conventional extrusion molding methods have involved the problem that nothing but a magnetic member with poor magnetic characteristics can be produced as compared with the above-mentioned injection molding method.

FIG. 1 is an explanatory illustration showing one example of extrusion molding method in a magnetic field, wherein a composition for resin magnets is heat molten in an extruder 1 and is extruded in a fluid state with a screw 2 into a magnetic field formed by a magnetic field-applied member 3 so as to form a molded product.

In such extrusion molding, the composition for resin magnets can be regarded as being a Bingham fluid at the temperature at the time of the extrusion molding, and the flow velocity is highest in the middle of the tube cross-section in a spinneret for the extruder and is lowest in the vicinity of the wall of the tube cross-section. As the result, since a magnetic field is applied in such a fluidity state, the magnetic powders that are to be orientated in the direction of the applied magnetic field are disturbed by the flow of the composition, whereby it is made difficult to obtain a magnetic member having a strong magnetic force. For instance, it is extremely difficult to obtain a magnetic molded-product having a surficial magnetic flux density exceeding 1000 Gauss with regard to magnetic molded products that are produced in the working examples of this specification hereinafter described unless the molding is carried out under specific condition.

In order to obtain a magnetic member having a desired magnetic force, an ideal flow pattern is considered to be a constant flow velocity of the composition in the same cross section of a spinneret. It is thought in this case that the magnetic member can be imparted with a strong magnetic force, since the orientation of the magnetic powders is totally unaffected by the friction and flow-velocity field due to the flow in the spinneret.

There has heretofore been taken, for instance, a countermeasure of enhancing the smoothness of the inside surface of a spinneret for the purpose of bringing the flow-velocity field at the time of extrusion molding to an ideal flow-velocity field. The above-mentioned countermeasure, however, has involved the problem that although effective at an extremely low extrusion velocity, it results in failure to exhibit the effect at a high extrusion velocity.

The extrusion molding method in a magnetic field, though being involved with such problem, is advantageous as compared with the injection molding method in that said extrusion molding method can shorten the molding tact and processing time because of continuous processing made possible, it can simplify and miniaturize the mold thus lowering the production cost thereof and at the same time, enables the production of a magnet roller excellent in uniformity of magnetic force such as lessened difference in the surficial magnetic force along the longitudinal direction. Under such circumstances, it has eagerly been desired to develop a technique enabling the production of a magnetic member such as magnet rollers and magnet pieces which has a strong magnetic force by means of an extrusion molding method in a magnetic field.

SUMMARY OF THE INVENTION

In such circumstances, a general object of the present invention is to provide a composition for the production of a resin magnet having a strong magnetic force, a magnetic member having a strong magnetic force obtainable by the use of the above-mentioned composition, and a process for efficiently producing said magnetic member.

In order to attain the above-mentioned object, intensive research and investigation were accumulated by the present inventors. As a result, attention has been paid to the fact that the composition for resin magnets can be regarded as being a Bingham fluid at the temperature at the time of extrusion molding, and the flow of said composition in a spinneret is preferably brought to an ideal state as close as possible by controlling its viscosity characteristics. In this connection, the following findings and information were obtained.

It has been found that the flow of a composition for resin magnets in a spinneret can be brought close to an ideal state, provided that $\eta_R/\eta_O$ and $\gamma$ together satisfy a definite relationship for $\eta_O$ measured within a specific range of temperature region and $\gamma$ being within a specific value, wherein with regard to the viscosity characteristics in molten state of said composition for resin magnets, $\eta_R$ represents shear stress (dyne/cm$^2$), $\eta_O$ denotes yield stress {shear stress (dyne/cm$^2$) when shear rate by extrapolation is zero} and $\gamma$ stands for shear rate ($S^{-1}$), whereby said composition can conform to the purpose of use as a molding material for magnetic members. Moreover it has been found that a magnetic member having a strong magnetic force can easily be obtained by subjecting said composition to the extrusion molding in a magnetic field under a specific temperature and pressure. The present invention has been accomplished by the foregoing findings and information.

Specifically the present invention provides:

(1) a composition for resin magnets which comprises a thermoplastic resin and magnetic powders and which, when determined in a heated molten state thereof, has viscosity characteristics characterized in that the almost linear line which is obtained by taking $\eta_R/\eta_O$ as ordinate and $\gamma$ as abscissa has a slope of at most 0.02 within a specific temperature range in which $\eta_O$ falls within the range of from $2.0\times10^6$ to $1.0\times10^7$ dyne/cm$^2$, wherein $\eta_R$ denotes shear stress (dyne/cm$^2$), $\eta_O$ denotes yield stress {shear stress (dyne/cm$^2$) when shear rate by extrapolation is zero} and $\gamma$ denotes shear rate ($S^{-1}$);

(2) a magnetic member which is produced by the use of the composition for resin magnets as set forth in the preceding item (1); and (3) a process for producing a magnetic member by subjecting the composition for resin magnets as set forth in the preceding item (1) to extrusion molding in a magnetic field at a temperature in the range of 80 to 300° C. at a pressure in the range of 10 to 300 kgf/cm$^2$.

DESCRIPTION OF SYMBOLS

Figure 1:
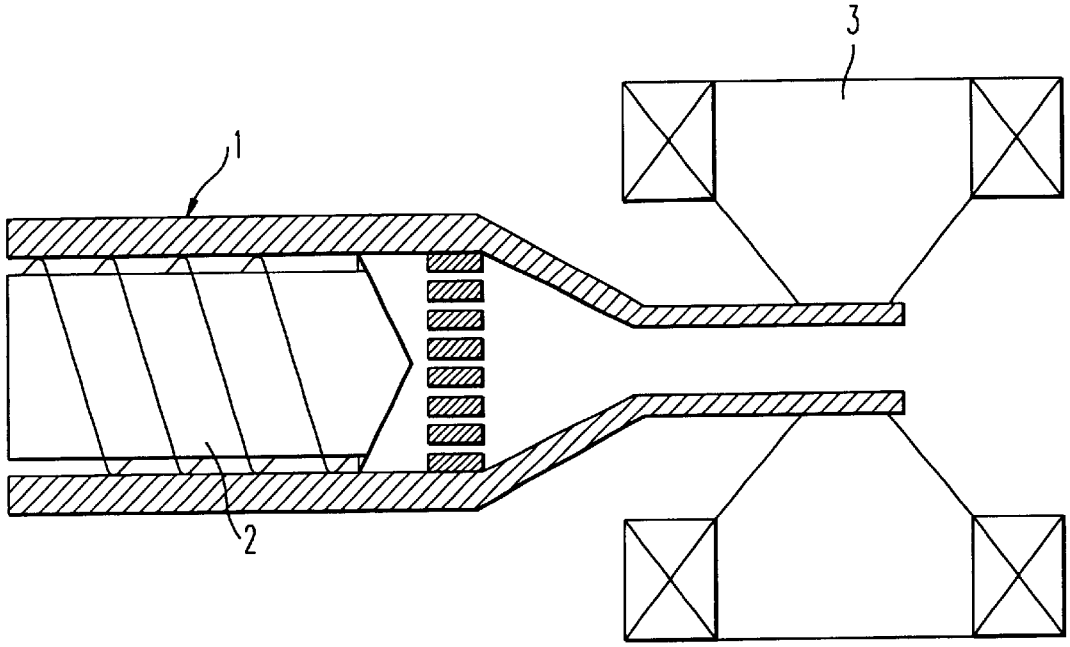
FIG. 1 is an explanatory illustration showing one example of extrusion molding method in a magnetic field.

1: extruder 2: screw 3: magnetic field-applied member

DESCRIPTION OF THE PREFERRED EMBODIMENTS

The composition for resin magnets according to the present invention, which comprises a thermoplastic resin and magnetic powders, is used as a molding material for a magnetic member such as magnet rollers, and is called upon to have the viscosity characteristics as described hereunder.

In the foregoing composition for resin magnets, when viscosity characteristics are measured in a heated molten state of said composition, the relation between $\eta_R/\eta_O$ and $\gamma$ is expressed approximately by a linear equation, and the resultant linear line which is obtained by taking $\eta_R/\eta_O$ as ordinate and $\gamma$ as abscissa has a slope C of at most 0.02, preferably at most 0.01, within a specific temperature range in which $\eta_O$ falls within the range of from $2.0\times10^6$ to $1.0\times10^7$ dyne/cm$^2$, preferably $3.0\times10^6$ to $8.0\times10^6$ dyne/cm$^2$ and within the range of $\gamma$ being at most $100S^{-1}$, preferably at most $50S^{-1}$, wherein $\eta_R$ denotes shear stress (dyne/cm$^2$) {in more detail, the shear stress when $\gamma$ is $S^{-1}$}, $\eta_O$ denotes yield stress {shear stress (dyne/cm$^2$) when shear rate by extrapolation is zero } and $\gamma$ denotes shear rate ($S^{-1}$). The C value, when exceeding 0.02, leads to difficulty in producing a magnetic member having a strong magnetic force.

When the shear stress is expressed by $\eta_{50}$ at a shear rate of $50S^{-1}$, the value of $\eta_{50}/\eta_O$ is preferably at most 3.0.

In the composition for resin magnets having such viscosity characteristics, the flow velocity thereof in a spinneret of an extruder is almost uniformized, the magnetic powders that are at to be orientated by an external magnetic field are suppressed from being disturbed by the flow of the aforesaid composition, and thereby a magnetic member having a strong magnetic force can be produced.

The above-described viscosity characteristics in the present invention are measured by the following method in accordance with the flow testing method in JIS K7210.

The samples for measuring the viscosity characteristics are each prepared by pelletizing a composition for resin magnets into a square of at most 5 mm in size and drying the resultant pellets in an oven at 80° C. for 24 hours. By using the samples maintained under a non-hygroscopic condition, measurements are made within one hour after the drying, of the viscosity characteristics by the use of a flow testing instrument (flow tester, manufactured by Shimadzu Corporation similar to that shown in the reference drawing 4 in accordance with JIS K7210 ) with a die configuration having extrusion holes each having a diameter of 1 mm and a length of 2 mm.

First of all, a testing load, which is set to 100 kgf/cm$^2$, is applied to the sample starting from about 100° C., followed by raising the temperature by steps of every 5° C. until the sample starts fluidization. Next, while maintaining the temperature at which the sample is fluidized in the die under the load of 100 kgf/cm$^2$, the load is gradually decreased by steps of every 5 to 10 kgf/cm$^2$ until the sample stops fluidization, when the viscosity characteristics are measured.

The yield stress $\eta_O$ and the aforesaid slope C value of the linear line can be found in the following manner.

<Yield Stress $\eta_O$>

In the case where three or more plotted data of shear rate being 30S$^{-1}$ or less are obtained in the foregoing procedure, the shear stress when shear rate is 0S$^{-1}$ is found out as yield stress $\eta_O$ by means of extrapolation to zero from these plotted data. In the case where if any, three or more plotted data of shear rate being 30S$^{-1}$ or less are not obtained in the above manner depending upon the type of the composition, then the yield stress $\eta_O$ is obtained by means of extrapolation to zero from three measured data including a first, second and third minimum values of shear rate.

<Slope C Value of the Linear Line>

The slope C value of the linear line is calculated according to the following formula:

$$C=(\eta 2-\eta 1)/\{\eta_O(\gamma 2-\gamma 1)\}$$

where, $\eta 1$; shear stress against minimum shear rate ($\gamma 1$)

$\eta 2$; shear stress against second minimum shear rate ($\gamma 2$)

The composition for resin magnets according to the present invention, which has the above-mentioned viscosity characteristics, comprises a thermoplastic resin as a resin binder and magnetic powders.

A mixed resin of vinyl chloride resin or a copolymer thereof and a copolymer of ethylene/vinyl acetate is suitable as the thermoplastic resin for imparting said composition with the foregoing viscosity characteristics. Examples of the vinyl chloride resin or a copolymer thereof include vinyl chloride homopolymer and a copolymer of vinyl chloride and ethylene, (meth)acrylic acid ester, vinyl acetate or the like.

The vinyl chloride resin or a copolymer thereof has an average degree of polymerization of preferably 500 to 2500, more preferably 800 to 2000. The average degree of polymerization, when being less than 500, sometimes results in lowered melt-viscosity and unstable configuration of a magnetic member, whereas the average degree of polymerization, when being more than 2500, sometimes brings about unreasonably high melt-viscosity, thus making molding by extrusion difficult in spite of enhanced strength of a magnetic member.

The vinyl chloride resin or a copolymer thereof may be used alone or in combination with at least one other On the other hand, preferable copolymer of ethylene/vinyl acetate is that having a vinyl acetate moiety content in the range of preferably 25 to 60% by weight, more preferably 30 to 55% by weight. The vinyl acetate moiety content thereof, when being less than 25% by weight, gives rise to a fear of deteriorating the miscibility of the same and vinyl chloride resin or a copolymer thereof, thus lowering the strength of a magnetic member to be obtained. On the contrary, the vinyl acetate moiety content thereof, when being more than 60% by weight, gives rise to a fear that the copolymer becomes liable to gel with the result of deteriorating the surface smoothness of a magnetic member to be obtained.

There is no specific limitation on the melt flow rate (MFR) of the copolymer of ethylene/vinyl acetate, however, the MFR (190° C., 2.16 kgf) by JIS K7210 as prescribed in JIS K6730 is preferably in the range of 10 to 1000 g/10 minutes. The MFR as prescribed in JIS 7210 includes manual method A and automatic method B, of which any method may be used to measure the MFR in the present invention.

There is no specific limitation on the blending ratio of the vinyl chloride resin or a copolymer thereof to the copolymer of ethylene/vinyl acetate, however, the blending ratio thereof is preferably 5:1 to 1:5 by weight, more preferably 3:1 to 1:3 by weight from the viewpoints of both the magnetic characteristics and dynamical strength.

As described hereinbefore, in the composition for resin magnets according to the present invention, there is preferably used a mixed resin of vinyl chloride resin or a copolymer thereof and a copolymer of ethylene/vinyl acetate as a thermoplastic resin, that is, a resin binder. In addition, the above-mentioned resin components may be blended at need, with at least one resin component selected from among ethylene/ethyl acrylate copolymer (EEA), epoxy resin, olefinic resin such as polyethylene and polypropylene, hydrogenated polyethylene, polyamide, styrenic resin, polyethylene terephthalate (PET), polybutylene terephthalate (PBT) and polyphenylene sulfide (PPS).

As the magnetic powders to be mixed with and dispersed in the aforesaid resin powders, there are usable well known magnetic powders which have heretofore been used in magnetic members such as magnet rollers. Specific examples thereof include magnetoplumbite type ferrite such as Sr ferrite and Br ferrite and powders of rare earth element series alloy such as Sm—Co alloy, Nd—Fe—B alloy and Ce—Co alloy. The magnetic powders can be subjected at need to well known pretreatment.

The particle size of the magnetic powders to be used in the present invention is not specifically limited, but is usually in the range of preferably 0.8 to 2.2 $\mu$m, particularly preferably 1.2 to 1.8 $\mu$m from the viewpoints of melt fluidity of the composition for resin magnets, orientational properties of the magnetic powders and packing ratio thereof.

The content of the above-mentioned magnetic powders in the composition for resin magnets according to the present invention is properly selected in accordance with the desired intensity of magnetic force of the objective magnetic member, and is usually selected in the range of 80 to 97% by weight.

The composition for resin magnets according to the present invention may be blended at need with additives such as dispersants for dispersing the aforesaid magnetic powders, lubricants and plasticizers and reinforcing fillers in addition to the foregoing resin binders and magnetic powders to the extent that the object of the present invention is not impaired by such additives or the like.

The usable dispersants are exemplified by phenolic dispersants and amine based dispersants. The preferably usable lubricants are exemplified by wax such as paraffin wax and microcrystalline wax, fatty acid such as stearic acid and oleic acid, metallic salts thereof such as calcium stearate and zinc stearate. The preferably usable plasticizers are exemplified by monoester base, polyester base and epoxy base plasticizers. Moreover, in the case of extrusion molding the composition for resin magnets of the present invention to form a magnetic member, said lubricant is preferably added to said composition in order to reduce the friction with a spinneret.

The preferably usable reinforcing fillers are exemplified by mica, whisker, talc, carbon fibers and glass fibers. In the case of relatively weak magnetic force required for a magnetic member and a relatively small filling amount of magnetic powders, the magnetic member is prone to be low in rigidity. In order to compensate for low rigidity, the magnetic member can be reinforced by adding a filler such as mica and whisker. The preferably usable fillers are exemplified by mica and whisker. Examples of the whisker include non-oxide base whisker composed of silicon carbide, silicon nitride and the like, metal oxide base whisker composed of ZnO, MgO, $TiO_2$, $SnO_2$, $Al_2O_3$ and the like, double oxide base whisker composed of potassium titanate, aluminum borate, basic magnesium sulfate and the like. Of these, double oxide base whisker is preferable from the aspect of easiness of preparing composite products with a plastic.

The blending ratio of said filler is not specifically limited, but is usually in the range of 0.1 to 7% by weight based on the total amount of the composition for resin magnets.

There is no specific limitation on the process for preparing the composition for resin magnets. Said composition can be prepared, for instance, by mixing a resin binder, magnetic powders and as necessary, an additive and a filler according to a conventional method, melt kneading the resultant mixture, and thereafter molding the same into pellets. In this case, a conventional method and condition may be adopted, for instance, the melt kneading step can be carried out by the use of a twin screw extruder, a KCK kneading extruder or the like.

As mentioned hereinbefore, the magnetic member according to the present invention such as magnet rollers and magnet pieces is prepared by molding the composition for resin magnets according to the present invention. The method for molding the composition is not specifically limited, provided that the method enables the production of a magnetic member having desired magnetic force characteristics and mechanical characteristics. However, the magnetic member having a strong magnetic force can efficiently be produced by using the extrusion molding method in a magnetic field according to the present invention as described hereunder.

The extrusion molding method in a magnetic field which is adopted in the present invention is advantageous in that said method can proceed with continuous processing, shorten molding tact, thus shorten processing hours, simplify mold structure, miniaturize the mold, and produce a magnetic member such as magnet rollers which is excellent in uniformity of magnetic force such as lessened difference in surficial magnetic force in the longitudinal direction.

In the method of the present invention, a desired magnetic member is produced by subjecting the composition for resin magnets to the extrusion molding method in a magnetic field under the conditions including a temperature in the range of 80 to 300° C., preferably 100 to 150° C. and a pressure in the range of 10 to 300 kgf, preferably 40 to 180 kgf.

As mentioned hereinbefore, a magnetic member having a strong magnetic force has been difficult to produce by any of conventional extrusion molding methods in a magnetic field. As opposed to the above, the present invention enables the production with ease, of a magnetic member having a strong magnetic force by virtue of the use of specific composition for resin magnets which is imparted with controlled viscosity characteristics.

A magnet roller prepared by using the composition for resin magnets according to the present invention, is usually constituted of a roller body comprising a resin magnet and a shaft portion which protrudes from both the ends of the roller body. In this case, a magnet roller constituted of a roller body and a shaft portion can be produced by pushing a shaft made of a metal or the like through a thick walled cylindrical roller produced by the above-mentioned extrusion molding method. A magnet roller body, when called upon to possess advanced and intricate magnetic force characteristics, may be produced by subjecting the composition for resin magnets to extrusion molding to form a plurality of magnet pieces in the above manner, and sticking the resultant magnet pieces on the external surface of a shaft made of a metal or the like.

The composition for resin magnets according to the present invention is favorably used as molding materials for the foregoing magnet rollers and magnet pieces without any limitation, and also as molding materials for a variety of magnetic members such as part items of electric motors and the like.

The composition for resin magnets according to the present invention, which is imparted with specific viscosity characteristics, can readily afford a magnetic member having a strong magnetic force such as magnet rollers and magnet pieces by means of extrusion molding method in a magnetic field. Consequently, the magnetic member according to the present invention is favorably employed in the development mechanism portions in the field of electrophographic equipment and electrostatic recording equipment such as copying machinery, facsimile machinery and printers.

In the following, the present invention will be described in more detail with reference to comparative examples and working example, which however shall not limit the present invention thereto.

EXAMPLE 1

The following materials were used as the materials for the composition for resin magnest.

Ferrite; anisotropic strontium ferrite, manufactured by Nippon Bengara Kogyo Co., Ltd.

Vinyl chloride resin; average degree of polymerization of 800, manufactured by Taiyo Shokai Co., Ltd., under the trade name "TH800"

Ethylene/vinyl acetate copolymer; vinyl acetate moiety content of 42% by weight, MFR of 70 g/10 min., manufactured by Tosoh Corporation, under the trade name "760"

Plasticizer; Di-2-ethylhexyl phthalate

A composition for resin magnets was prepared by kneading with a twin screw kneader, 91.0 parts by weight of said ferrite, 8.0 parts by weight of the mixed resin consisting of said vinyl chloride resin and said ethylene/vinyl acetate copolymer at a ratio by weight of 5:5 and 1.0 part by weight of said plasticizer.

Subsequently, a measurement was made of the viscosity characteristics of the composition thus obtained in accordance with the method as described in the text of the specification. Thus in FIG. 2, the shear stress $\eta_R$ was plotted as ordinate against the shear rate $\gamma$ as abscissa at temperatures of 125° C., 135° C. and 145° C., respectively in order to obtain the relationship therebetween. FIG. 3 is a graph indicating the relationship between the $\eta_R/\eta_O$ and the shear rate $\gamma$ at $100S^{-1}$ and less.

Figure 2:
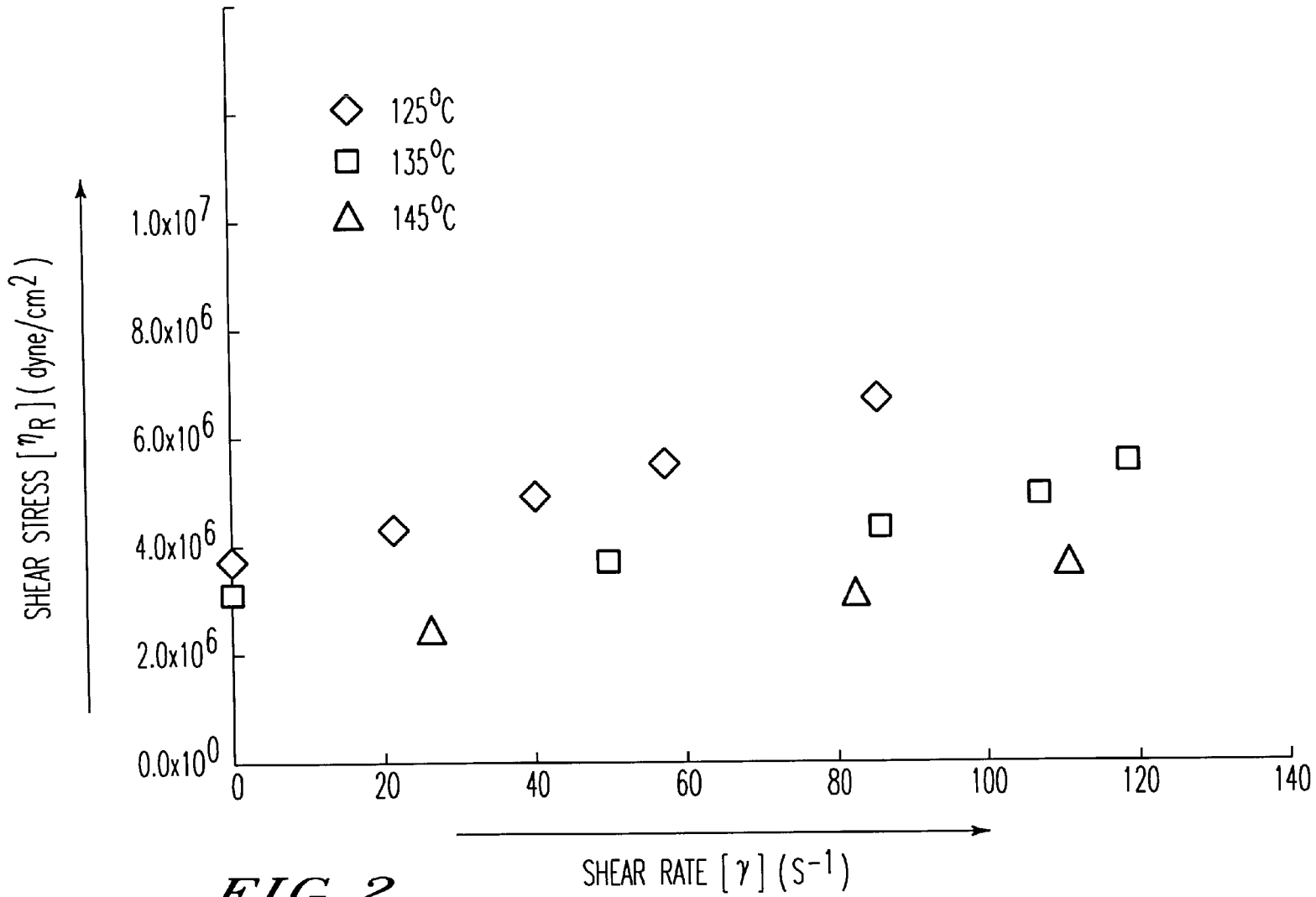
FIG. 2 is a plot drawing showing the relationship between shear rate $\gamma$ and shear stress $\eta_R$ at each temperature of the composition for resin magnets as obtained in the example.
Figure 3:
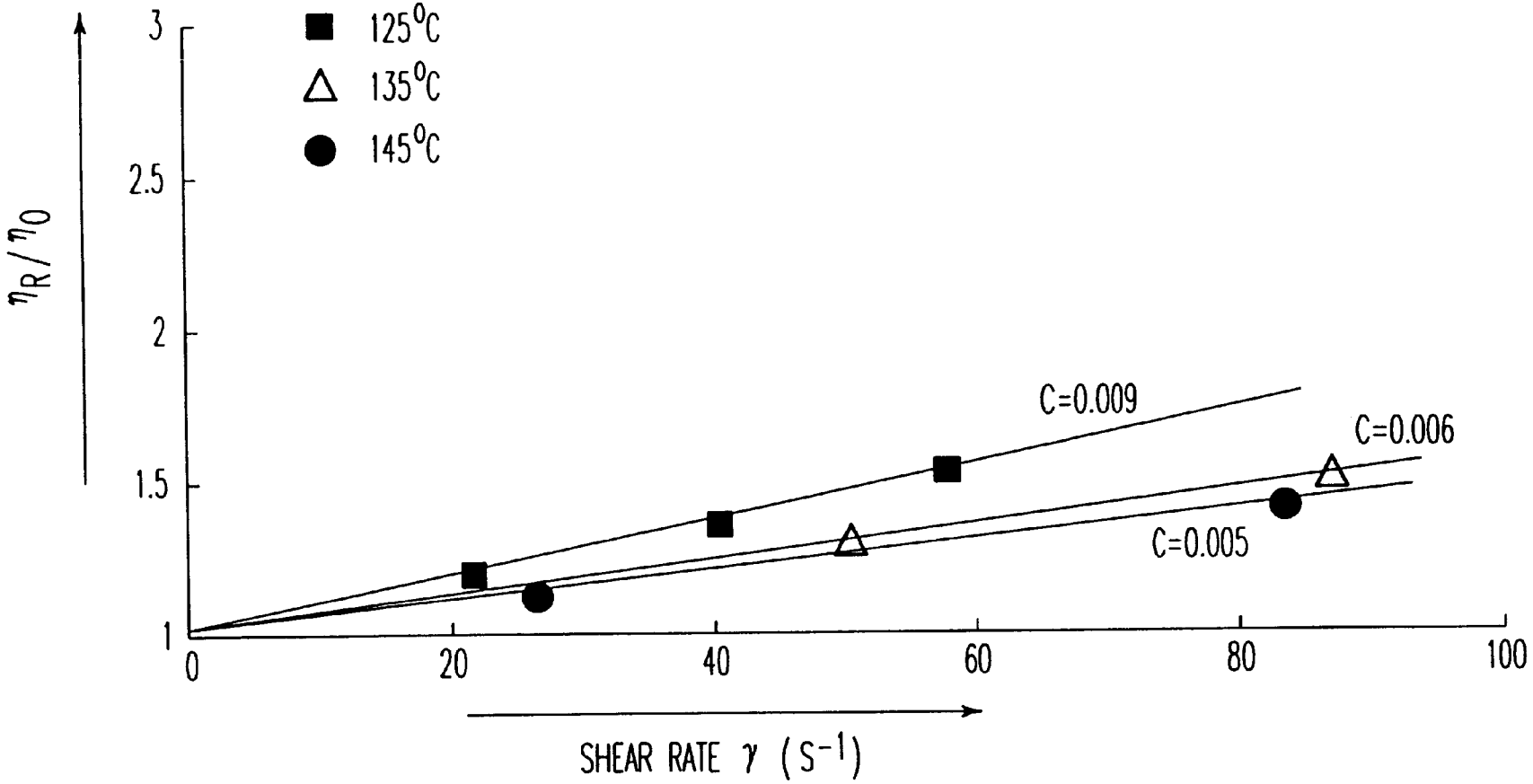
FIG. 3 is a graph showing the relationship between shear rate $\gamma$ and $\eta_R/\eta_O$ at each temperature of the composition for resin magnets as obtained in the example.

As can be seen from FIG. 2, the yield stress $\eta_O$ is entirely in the range of from $2.0\times10^6$ to $1.0\times10^7$ dyne/cm$^2$ at temperatures of 125° C., 135° C. and 145° C., respectively. Further as can be seen from FIG. 3, the C value at each temperature is at most 0.02.

Figure 4:
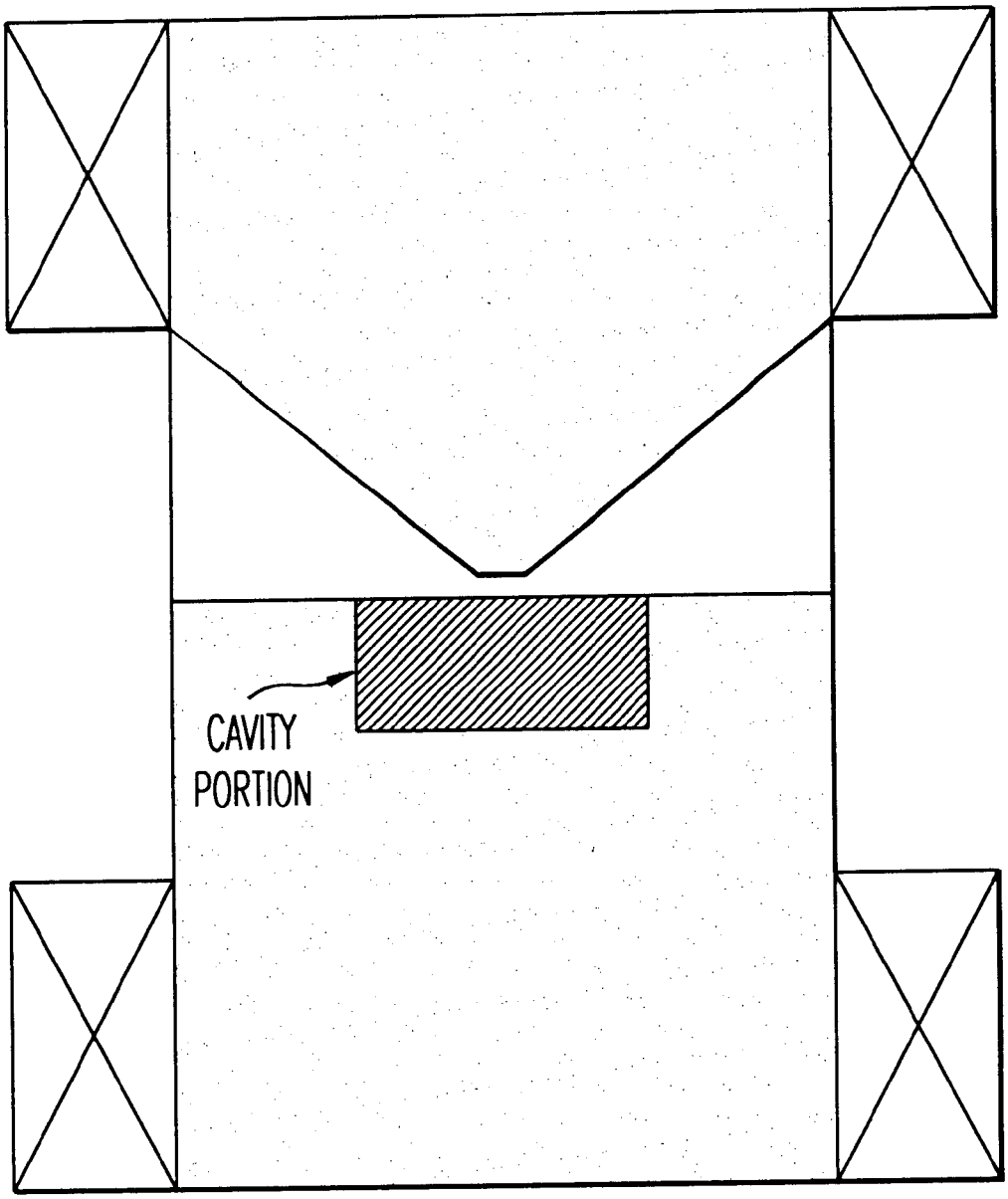
FIG. 4 is an explanatory illustration showing a configuration of the molded products as obtained by extrusion molding in a magnetic field in the example and comparative examples, wherein a molding device is shown and the molded product is shown in the cavity portion.

Thereafter, the above-mentioned composition for resin magnets was subjected to extrusion molding in a magnetic field at a temperature of 135° C. and a pressure of 100 kgf at various extrusion rates to produce the molded products of the shape as illustrated in FIG. 4. Thus there was obtained the relationship between the surficial magnetic force of the resultant molded product and the extrusion rate by plotting the former as ordinate against the latter as abscissa in FIG. 5.

Figure 5:
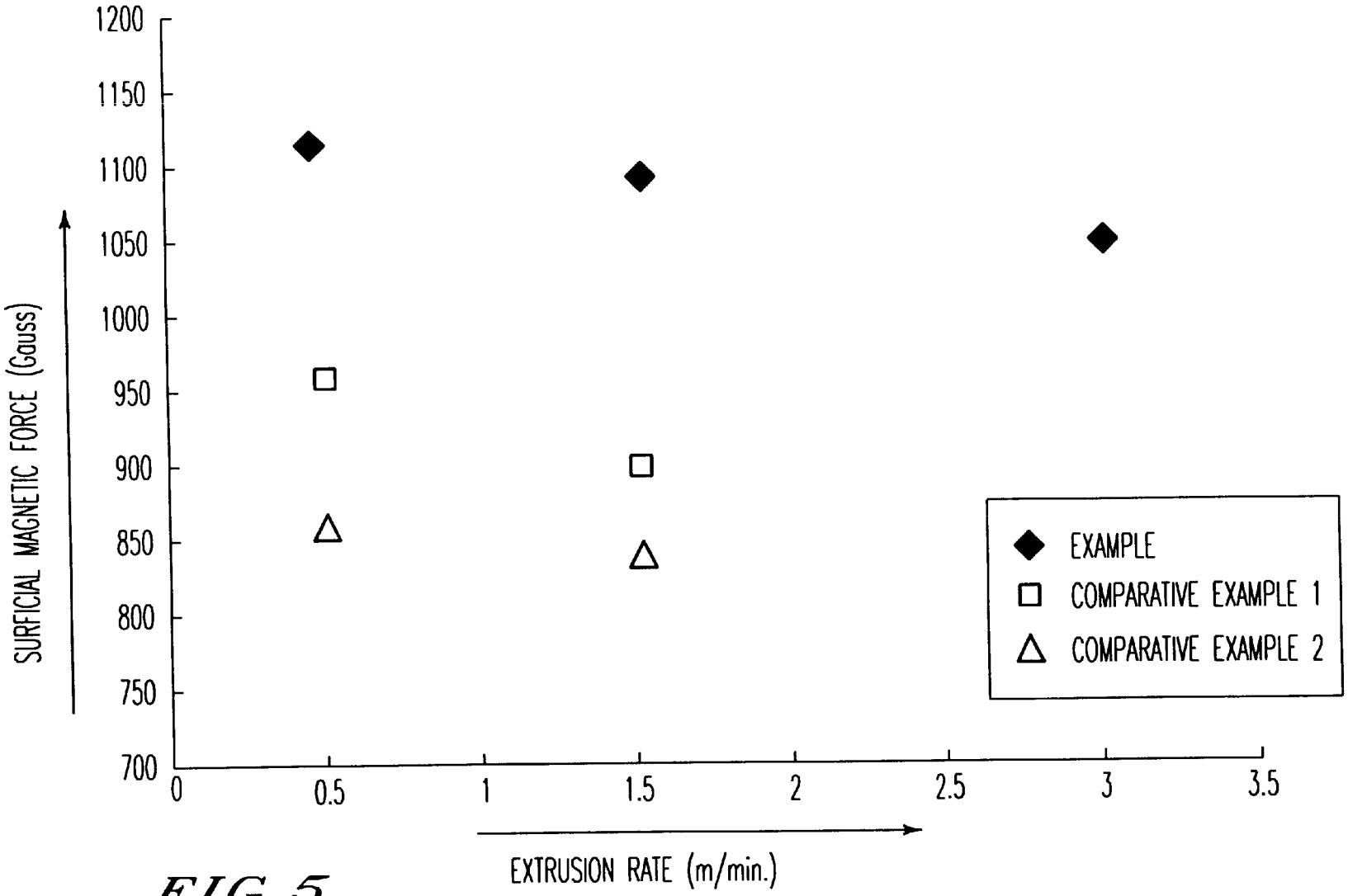
FIG. 5 is a plot drawing showing the relationship between surficial magnetic force and extrusion rate for the molded products as obtained in the example and Comparative Examples 1 and 2.

As can be seen from FIG. 5, each of the plotted data in this example pointed out a value of surficial magnetic force of at least 1000 Gauss.

In addition, in the same manner as the foregoing, said composition for resin magnets was subjected to extrusion molding in a magnetic field at a pressure in the range of 10 to 350 kgf at a definite extrusion rate of 1.0 m/minute at various temperatures so as to vary the yield stress $\eta_O$ to produce the molded products. Thus there was obtained the relationship between the surficial magnetic force of the resultant molded products and the yield stress $\eta_O$ by plotting the former as ordinate against the latter as abscissa in FIG. 6.

Figure 6:
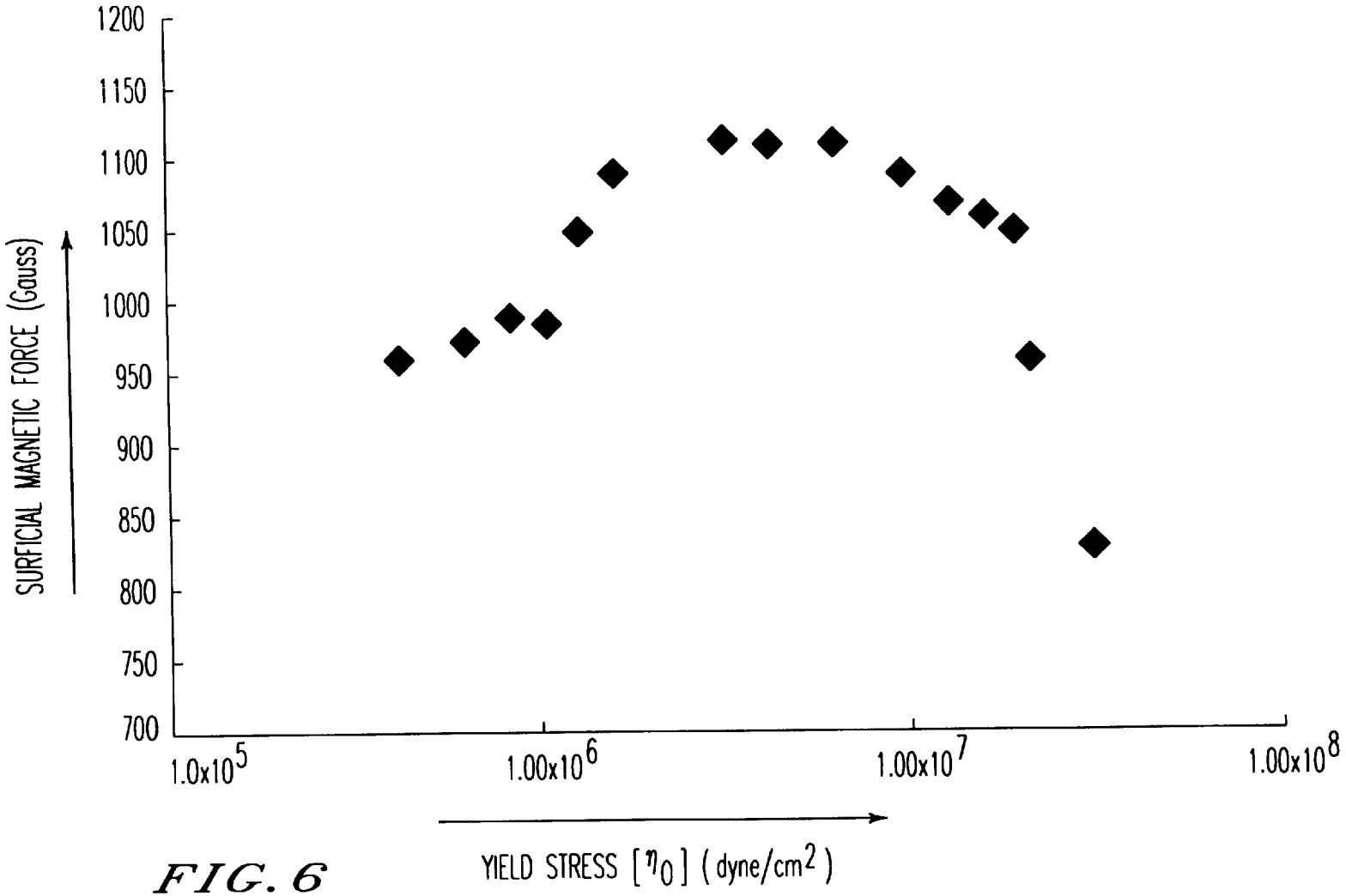
FIG. 6 is a plot drawing showing the relationship between surficial magnetic force and yield stress $\eta_O$ for the molded product as obtained in the example.

As can be seen from FIG. 6, surficial magnetic forces having high values were obtained for the yield stress $\eta_O$ within the range of from $2.0\times10^6$ to $1.0\times10^7$ dyne/cm$^2$.

Comparative Example 1

The procedure in Example 1 was repeated to prepare a composition for resin magnets except that use was made of the mixed resin consisting of the vinyl chloride resin (same as that in Example 1) and chlorinated polyethylene (manufactured by Showa Denko, K.K. under the trade name "Elaslens") at a ratio by weight of 5:5 in place of the mixed resin consisting of said vinyl chloride resin and said ethylene/vinyl acetate copolymer.

Figure 7:
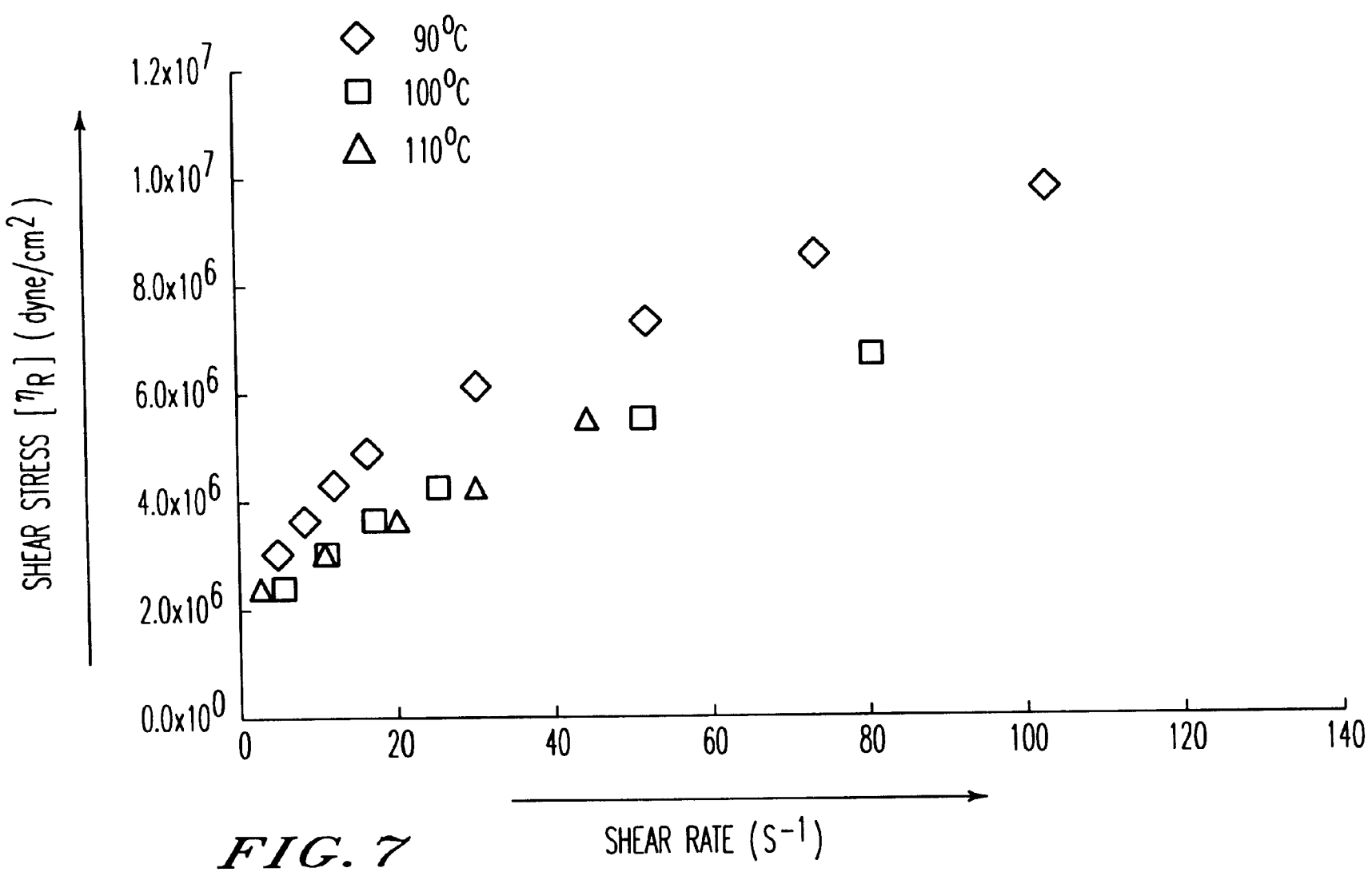
FIG. 7 is a plot drawing showing the relationship between shear rate $\gamma$ and shear stress $\eta_R$ at each temperature of the composition for resin magnets as obtained in Comparative Example 1.
Figure 8:
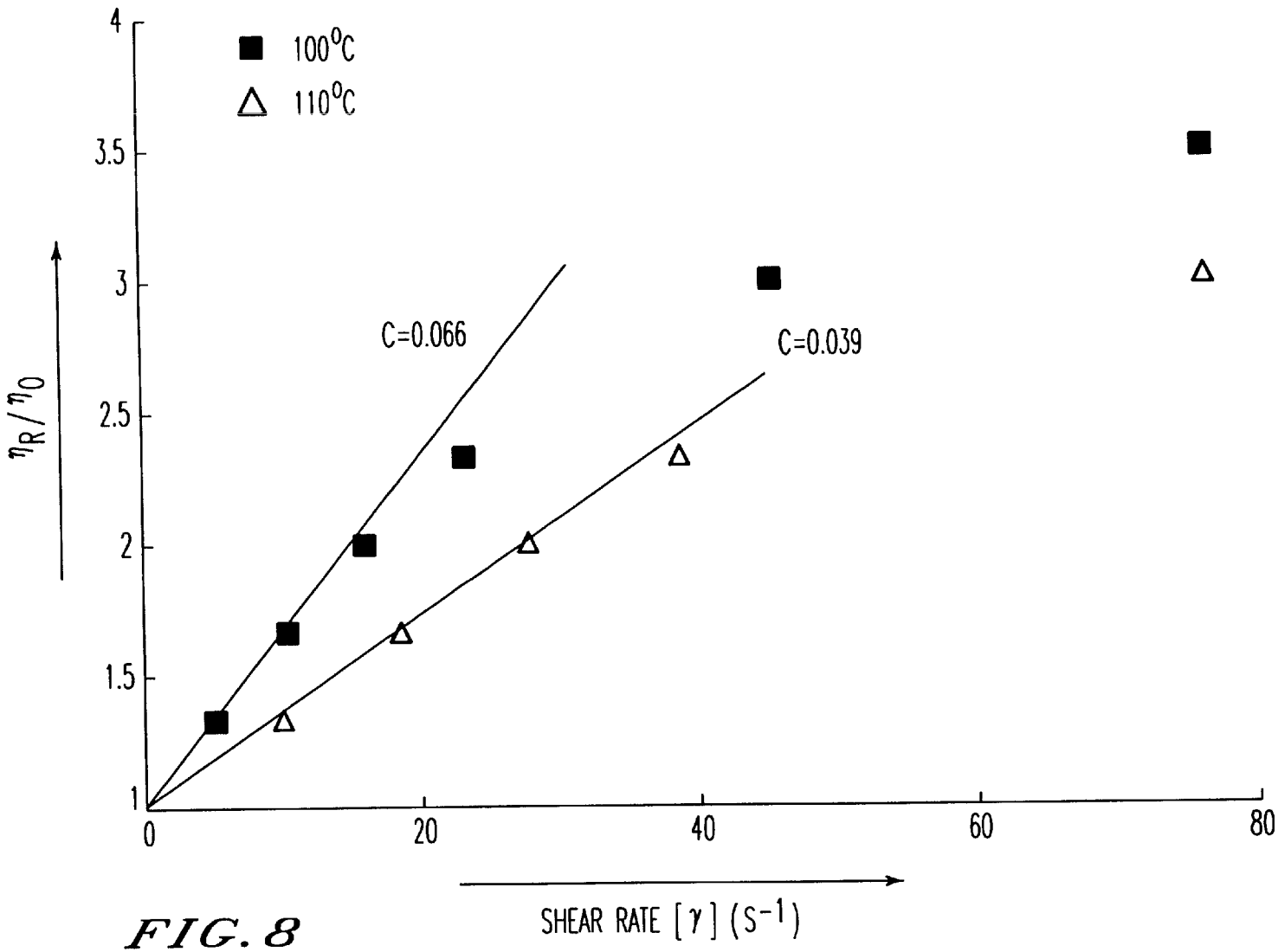
FIG. 8 is a graph showing the relationship between shear rate $\gamma$ and $\eta_R/\eta_O$ at each temperature of the composition for resin magnets as obtained in Comparative Example 1.

Subsequently, a measurement was made of the viscosity characteristics of the composition thus obtained in accordance with the method as described in the text of the specification. Thus in FIG. 7, the shear stress $\eta_R$ was plotted as ordinate against the shear rate $\gamma$ as abscissa at temperatures of 90° C., 100° C. and 110° C., respectively in order to obtain the relationship therebetween. FIG. 8 is a graph indicating the relationship between the $\eta_R/\eta_O$ and the shear rate $\gamma$ at $80S^{-1}$ and less.

As can be seen from FIG. 8, the C value was 0.066 at 100° C. and 0.039 at 110° C., which were high as compared with the C value in the example.

Thereafter, the above-mentioned composition for resin magnets was subjected to extrusion molding in a magnetic field at a temperature of 100° C. and a pressure in the range of 95 to 180 kgf at various extrusion rates to produce the molded products of the shape as illustrated in FIG. 4. Thus there was obtained the relationship between the surficial magnetic force of the resultant molded products and the extrusion rate by plotting the former as ordinate against the latter as abscissa in FIG. 5.

As can be seen from FIG. 5, the surficial magnetic force was small, and less than 1000 Gauss at every extrusion rate.

Comparative Example 2

The procedure in Example 1 was repeated to prepare a composition for resin magnets except that use was made of the mixed resin consisting of ethylene/ethyl acrylate copolymer (manufactured by Nippon Unicar Co., Ltd. under the trade name "DPDJ6169") and polypropylene resin (manufactured by Nippon Polyolefin Co., Ltd. under the trade name "Adlax EP320P") at a ratio by weight of 6:4 in place of the mixed resin consisting of said vinyl chloride resin and said ethylene/vinyl acetate copolymer.

Figure 9:
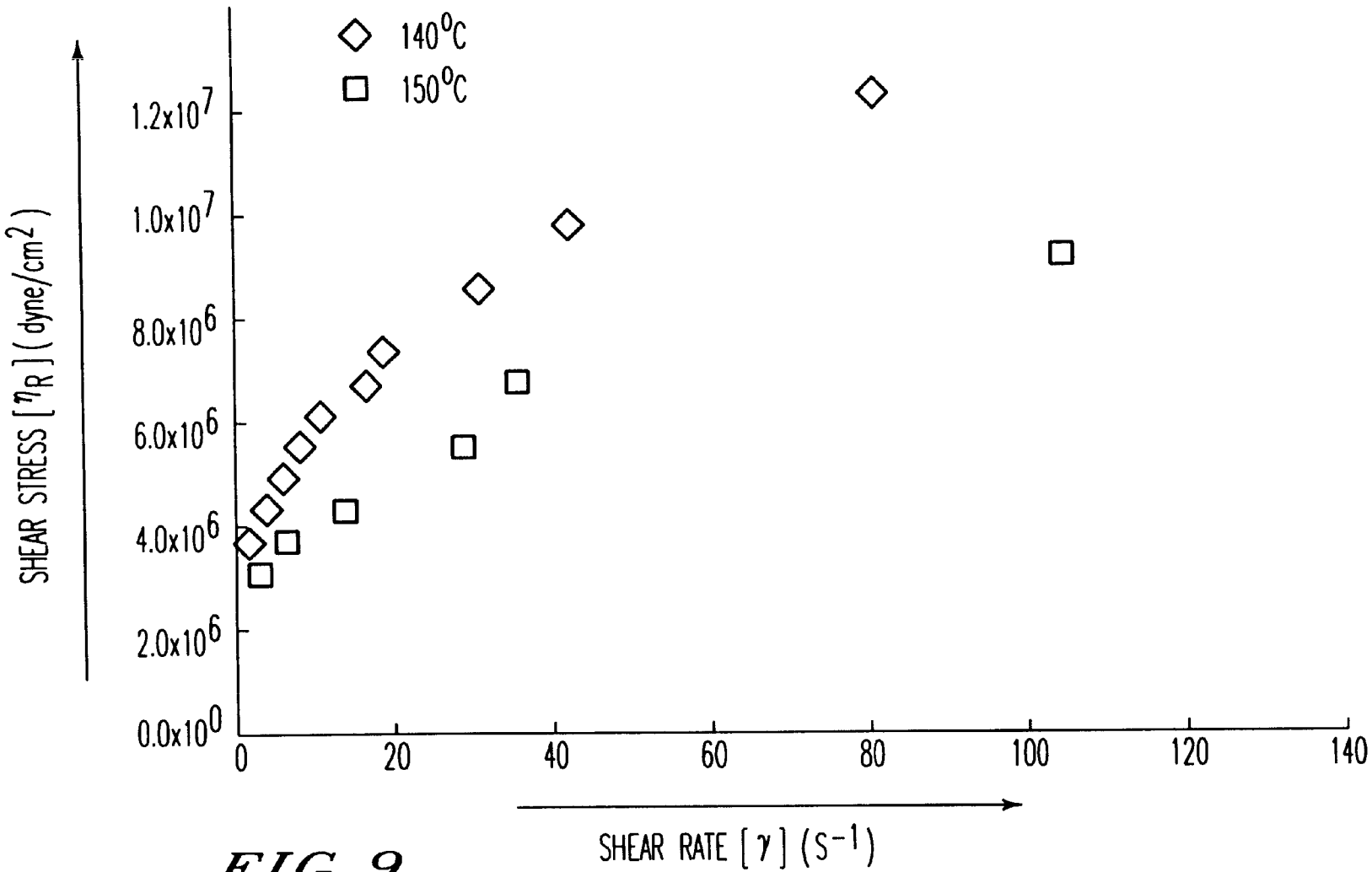
FIG. 9 is a plot drawing showing the relationship between shear rate $\gamma$ and shear stress $\eta_R$ at each temperature of the composition for resin magnets as obtained in Comparative Example 2.
Figure 10:
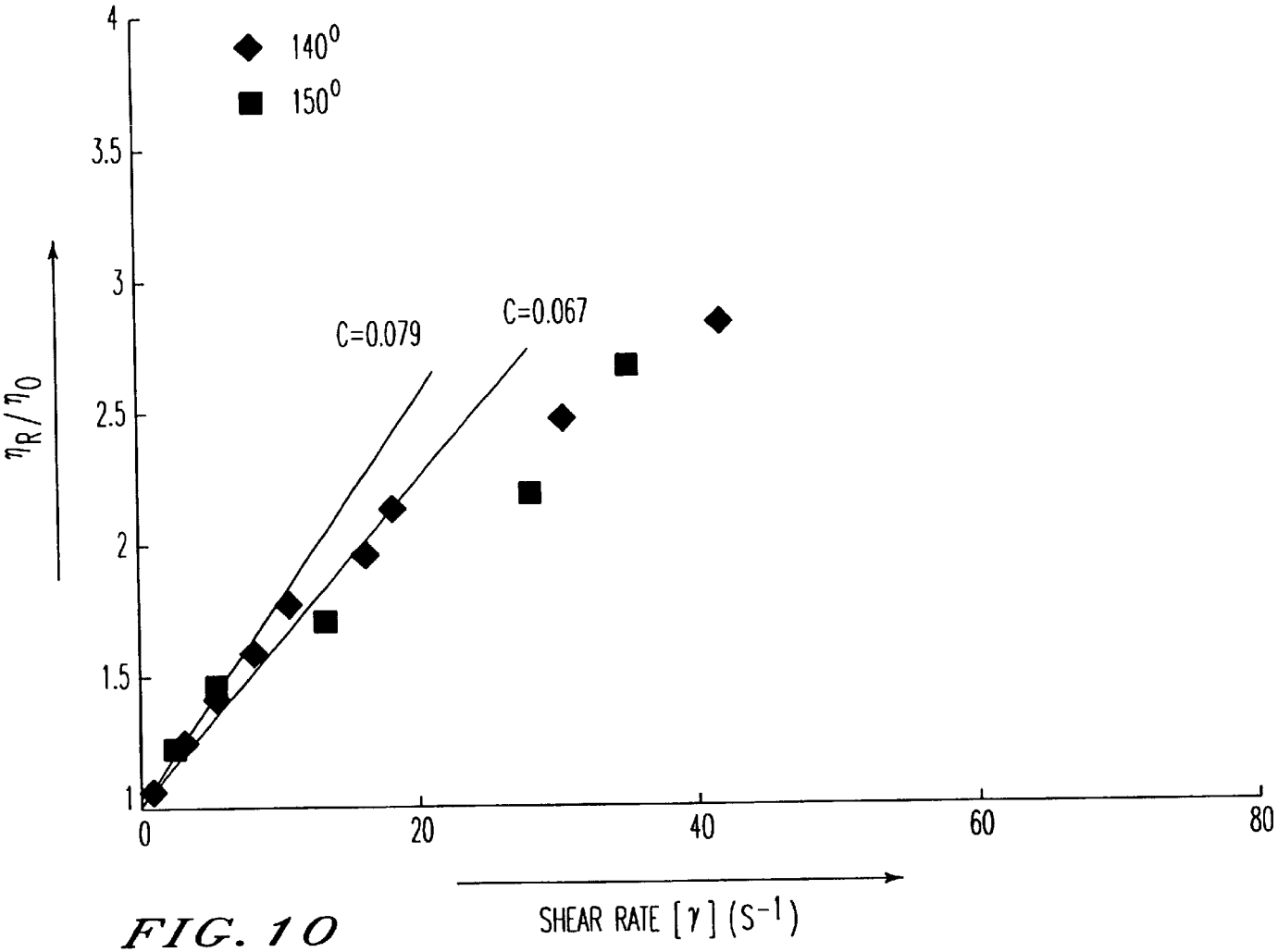
FIG. 10 is a plot drawing showing the relationship between shear rate $\gamma$ and $\eta_R/\eta_O$ at each temperature of the composition for resin magnets as obtained in Comparative Example 2.

Subsequently, a measurement was made of the viscosity characteristics of the composition thus obtained in accordance with the method as described in the text of the specification. Thus in FIG. 9, the shear stress $\eta_R$ was plotted as ordinate against the shear rate $\gamma$ as abscissa at temperatures of 140° C. and 150° C., respectively in order to obtain the relationship therebetween. FIG. 10 is a graph indicating the relationship between the $\eta_R/\eta_O$ and the shear rate $\gamma$ at $50S^{-1}$ and less.

As can be seen from FIG. 10, the C value was 0.079 at 140° C. and 0.067 at 150° C., which were high as compared with the C value in the example.

Thereafter, the above-mentioned composition for resin magnets was subjected to extrusion molding in a magnetic field at a temperature of 180° C. and a pressure in the range of 80 to 160 kgf at various extrusion rates to produce the molded products of the shape as illustrated in FIG. 4. Thus there was obtained the relationship between the surficial magnetic force of the resultant molded products and the extrusion rate by plotting the former as ordinate against the latter as abscissa in FIG. 5.

As can be seen from FIG. 5, the surficial magnetic force was small, and about 850 Gauss at every extrusion rate.

What is claimed is:

1. A magnetic member comprising a resin magnet composition comprising:

a mixed resin of vinyl chloride resin or a copolymer thereof and a copolymer of ethylene/vinyl acetate and magnetic powders and which, when determined in a heated molten state thereof, has viscosity characteristics characterized in that the almost linear line which is obtained by taking $\eta_R/\eta_O$ as ordinate and $\gamma$ as abscissa has a slope of at most 0.02 within a specific temperature range in which $\eta_O$ falls within the range of from $2.0\times10^6$ to $1.0\times10^7$ dyne/cm$^2$, wherein $\eta_R$, denotes shear stress (dyne/cm$^2$), $\eta_O$ denotes yield stress {shear stress (dyne/cm$^2$) when shear rate by extrapolation is zero} and $\gamma$ denotes shear rate ($S^{-1}$);

wherein said magnetic member has a surficial magnetic force of between 1000 to 1150 Gauss for a yield stress $\eta_O$ within the range of from $2.0\times10^6$ to $1.0\times10^7$ dyne/cm$^2$.

2. The magnetic member according to claim 1, wherein said almost linear line has a slope of at most 0.01.

3. The magnetic member according to claim 1, wherein the magnetic powders are contained in an amount of 80 to 97% by weight based on said composition.

4. The magnetic member according to claim 1, wherein said magnetic member is a magnetic roller or a magnetic piece.

5. A process for producing the magnetic member as claimed in claim 1, which comprises subjecting the resin magnet composition to extrusion molding in a magnetic field at a temperature in the range of 80 to 300° C. at a pressure in the range of 10 to 300 kgf/cm$^2$.

6. The process for producing a magnetic member according to claim 5, wherein the temperature is in the range of 100 to 150° C., and the pressure is in the range of 40 to 180 kgf/cm$^2$.

7. The process for producing a magnetic member according to claim 5, wherein said magnetic member is a magnetic roller.

8. The process for producing a magnetic member according to claim 5, wherein said magnetic member is a magnetic piece.

9. A magnetic roller, comprising a resin magnet composition comprising:

a mixed resin of vinyl chloride resin or a copolymer thereof and a copolymer of ethylene/vinyl acetate and magnetic powders and which, when determined in a heated molten state thereof, has viscosity characteristics characterized in that the almost linear line which is obtained by taking $\eta_R/\eta_O$ as ordinate and $\gamma$ as abscissa has a slope of at most 0.02 within a specific temperature range in which $\eta_O$ falls within the range of from $2.0\times10^6$ to $1.0\times10^7$ dyne/cm$^2$, wherein $\eta_R$, denotes shear stress (dyne/cm$^2$), $\eta_O$ denotes yield stress {shear stress (dyne/cm$^2$) when shear rate by extrapolation is zero} and $\gamma$ denotes shear rate ($S^{-1}$).

10. The magnetic roller according to claim 9, wherein said almost linear line has a slope of at most 0.01.

11. The magnetic roller according to claim 9, wherein the magnetic powders are contained in an amount of 80 to 97% by weight based on said composition.

12. A process for producing the magnetic roller as claimed in claim 9, which comprises subjecting the resin magnet composition to extrusion molding in a magnetic field at a temperature in the range of 80 to 300° C. at a pressure in the range of 10 to 300 kgf/cm$^2$.

13. The process for producing a magnetic roller according to claim 12, wherein the temperature is in the range of 100 to 150° C.

14. The process for producing a magnetic roller according to claim 12, wherein the pressure is in the range of 40 to 180 kgf/cm$^2$.

* * * * *